US005235157A

United States Patent [19]

Blackburn

[11] Patent Number: 5,235,157

[45] Date of Patent: Aug. 10, 1993

[54] BATTERY POWERED CIGARETTE LIGHTER HAVING RECESSED HEATING ELEMENT AND NORMALLY OPEN PIVOTALLY ACTUATED SWITCH

[75] Inventor: William G. Blackburn, Clearwater, Fla.

[73] Assignee: Electra-Lite, Inc., Clearwater, Fla.

[21] Appl. No.: 817,564

[22] Filed: Jan. 7, 1992

[51] Int. Cl.[5] ..... F23Q 7/00; H05B 1/02; F21L 7/00

[52] U.S. Cl. ..... 219/268; 219/262; 219/267; 362/196; 362/200

[58] Field of Search ..... 219/260–270; 361/264–266; 362/189, 200, 196, 205

[56] References Cited

U.S. PATENT DOCUMENTS

| | | | |
|---|---|---|---|
| 2,030,011 | 2/1936 | MacLennan | 219/268 X |
| 2,240,678 | 5/1941 | Stanard | 219/268 X |
| 2,249,692 | 7/1941 | Gelardin | 362/200 |
| 2,465,114 | 3/1949 | Oury | 362/196 |
| 2,516,843 | 8/1950 | Bakst et al. | 219/268 |
| 2,535,665 | 12/1950 | Boyarsky et al. | 219/268 X |
| 3,057,992 | 10/1962 | Baker | 362/200 |
| 3,175,080 | 3/1965 | Moore | 362/196 |
| 3,345,508 | 10/1967 | Chung | 362/196 |
| 3,379,856 | 4/1968 | Hirsch | 219/268 X |
| 3,392,265 | 7/1968 | King et al. | 219/268 X |
| 3,711,699 | 1/1973 | Bacevius | 362/189 |
| 4,816,971 | 3/1989 | Chin | 219/220 X |

FOREIGN PATENT DOCUMENTS

| | | | |
|---|---|---|---|
| 2348106 | 3/1975 | Fed. Rep. of Germany | 219/260 |
| 2353572 | 5/1975 | Fed. Rep. of Germany | 362/200 |
| 149162 | 11/1931 | Switzerland | 219/268 |
| 254621 | 12/1948 | Switzerland | 219/268 |
| 350823 | 1/1961 | Switzerland | 219/268 |
| 2232754 | 12/1990 | United Kingdom | 219/268 |

*Primary Examiner*—Anthony Bartis

*Attorney, Agent, or Firm*—Joseph C. Mason, Jr.; Ronald E. Smith

[57] ABSTRACT

A portable electric cigarette pocket cigarette lighter has a pair of mating housing halves of plastic defining a hollow parallelpiped housing in which is disposed a pair of AA penlight batteries in side-by-side relation and electrically connected through a normally open switch to a spiral electric heating element of Nichrome positioned in the housing in axial alignment with an opening in the housing front wall of size sufficient just to admit the leading end of a cigarette therethrough into contact with the heating element. A plurality of peg members disposed on the housing halves position a plurality of sheet metal conductors which electrically connect the battery, heating element and switch in a series circuit completed by manual closure of the switch to energize the heating element to light the inserted cigarette. The switch includes contacts integrally formed with a pair of the conductors and operated by an actuator pivotally mounted on one of the peg members in an aperture in the front wall of the housing below the cigarette admission hole and biased to its open position by a torsion spring on the same peg member. The recessed positioning of the heating element inhibits intentional setting of fires.

8 Claims, 1 Drawing Sheet

BATTERY POWERED CIGARETTE LIGHTER HAVING RECESSED HEATING ELEMENT AND NORMALLY OPEN PIVOTALLY ACTUATED SWITCH

TECHNICAL FIELD

This invention relates, generally, to portable cigarette lighters. More particularly, it relates to a battery-operated lighter having a recessed lighting means.

BACKGROUND ART

Cigarette lighters commonly include a capillary action-dependent wick having a lower end immersed in a fuel and a rotatably mounted flint, disposed in closely spaced relation to the wick, that produces a spark when rotated against a fixed position abrasive member. These lighters have a number of well-known disadvantages relating to the need to maintain fuel therein, the inefficiency of the flint-based spark-producing means, and the like. Moreover, the lighters can be used to start fires, whether intentionally or not.

Additional drawbacks of such conventional lighters are equally well known. For example, the lighter fluid has an unpleasant smell. Moreover, the lighters are heavy and not inexpensive.

Many inventors have developed improvements to the common lighter. Chuange, in U.S. Pat. No. 4,507,704, discloses a battery operated cigarette lighter that provides current that heats a heating element that is positioned within a housing. That device is believed to be the most pertinent of the earlier patents; however, it is believed to be too heavy, large, and expensive to find acceptance in the marketplace.

Additional U.S. patents of interest include U.S. Pat. Nos. 2,030,011, 2,528,619, 2,991,875, and 4,621,649.

Although the art of cigarette lighters is well-developed, there remains a need for a lighter that cannot be used to start intentional or unintentional fires. There is also a need for a very inexpensive and light in weight lighter which is also wind proof and damp proof.

The prior art, however, when considered as a whole in accordance with the requirements of law at the time the present invention was made, neither taught nor suggested to those of ordinary skill in this art how an improved lighter could be provided.

SUMMARY OF INVENTION

Two AA penlight batteries, or equivalent, are housed in a small, light-in-weight plastic housing and are connected to one another in series to provide ample voltage and current to a spirally-wound Nichrome wire heating element when pivotally mounted switch actuator is pressed upon to close a switch means. The switch actuator is biased away from the switch means so that said switch means is normally open. The heating element is positioned within the hollow cavity formed by the housing in recessed relation to a preselected sidewall of said housing, and said sidewall is apertured to provide access to said heating element. In this manner, a cigarette is lit by inserting its leading end through the aperture into abutting relation to the heating element. The recessed positioning of the heating element and the small diameter of the aperture prevents inadvertent insertion of an object and inhibits intentional setting of fires.

The primary object of this invention is to provide a small, light, inexpensive cigarette lighter.

Another important object is to provide a cigarette lighter that is safe to operate.

Still another important object is to provide a battery-operated lighter.

These and other important objects, features and advantages of the invention will become apparent as this description proceeds.

The invention accordingly comprises the features of construction, combination of elements and arrangement of parts that will be exemplified in the construction hereinafter set forth, and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE INVENTION

Figure 1:
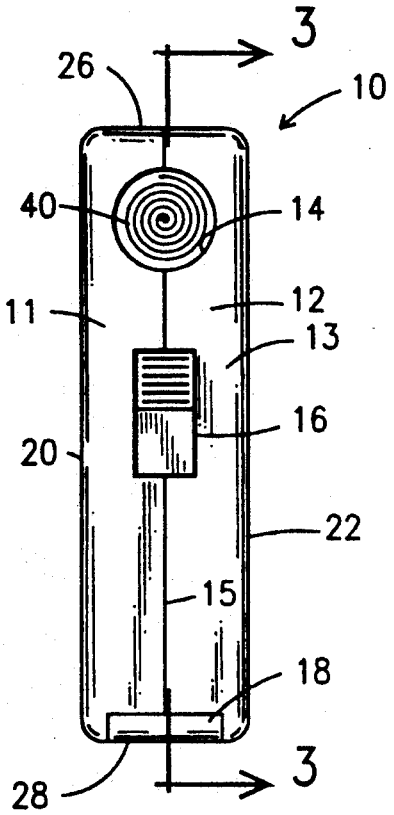
FIG. 1 is a front elevational view of an exemplary embodiment of the invention.

Referring now to FIG. 1, it will there be seen that an illustrative embodiment of the invention is denoted as a whole by the reference numeral 10. The commercial embodiment of the invention will be sold under the trademark "Electra-Lite".

Lighter 10 includes front wall 12 having opening 14 formed therein; the predetermined diameter of opening 14 is slightly greater than the diameter of a standard cigarette.

Switch actuator 16 is of the pivotally mounted type, as will be more fully set forth hereinafter. Removable closure means 18 provides access to the batteries as needed in the well-known way.

Figure 2:
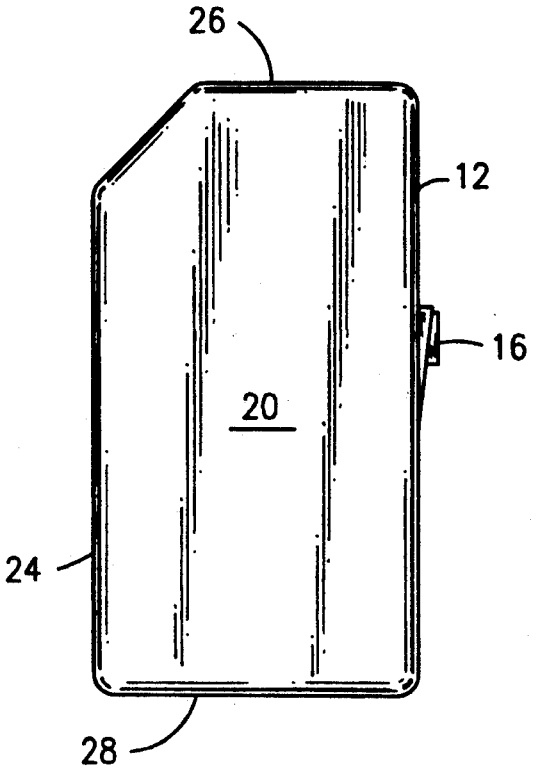
FIG. 2 is side elevational view thereof.

As perhaps best understood by comparing FIGS. 1 and 2, lighter 10 has a generally parallelepiped construction; it includes side walls 20, 22, rear wall 24, top wall 26 and bottom wall 28. The walls define a hollow cavity within which are positioned the batteries, the electrical conductors, the mounting means for switch actuator 16, and the heating element. The walls are of thin but durable plastic construction so that the lighter 10 is light-in-weight and small. Housing 12 is made of two mating halves, 11, 13, as indicated by parting line 15 in FIG. 1.

Figure 3:
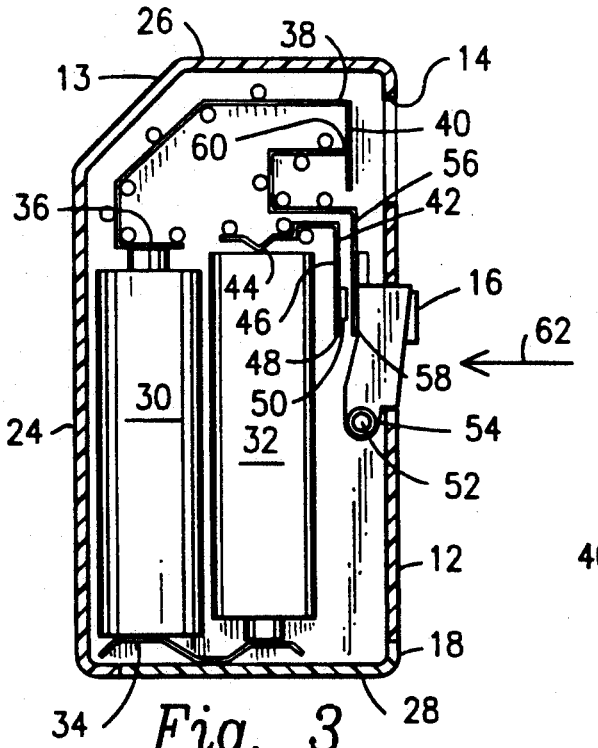
FIG. 3 is a sectional view taken along line 3—3 in FIG. 1.
Figure 4:
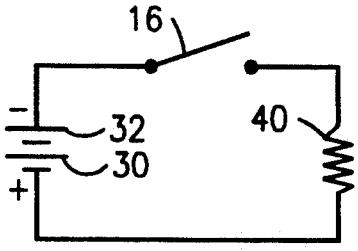
FIG. 4 is a schematic diagram of the electrical circuit of the present invention.
Figure 5:
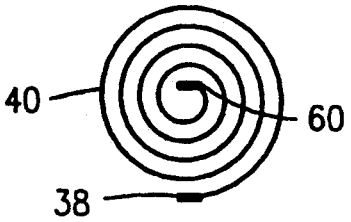
FIG. 5 is an elevational view of the heating element employed in the novel lighter.

As shown in FIG. 3, batteries 30 and 32 are conventional AA penlight batteries, or other suitable equivalent; a first quarter inch wide sheet metal conductor 34 is in simultaneous electrical communication with the negative pole of battery 30 and the positive pole of battery 32 as depicted. The positive pole of battery 30 is in electrical communication with a second conductor 36 of like construction; said conductor 36 is bent several times as shown and terminates in terminal 38 of heating element 40.

The negative pole of battery 32 is in electrical communication with a third quarter inch wide sheet metal conductor 42; it is bent as shown to include a point 44 to ensure a good contact. Conductor 42 further includes a section 46 that is disposed in parallel relation to battery 32 and front wall 12. Importantly, section 46 has a free distal end 48 that is not mounted to anything. Moreover, an electrical contact 50 is secured to said distal end 48.

Switch actuator 16 is pivotally mounted to a peg 52 that extends between side walls 20 and 22. A torsion spring 54 encircles the peg 52 and biases switch actuator 16 away from contact 50 so that no current may flow from batteries 30, 32, when switch actuator 16 is in repose; both FIGS. 2 and 3 show said switch actuator in said position of repose.

A fourth quarter inch wide sheet metal conductor 56 has a free end 58 secured to switch actuator 16 and its opposite end is secured to terminal 60 of heating element 40. Thus, when switch actuator 16 is pushed in the direction indicated in FIG. 3 by directional arrow 62, free end 58 of conductor 56 makes abutting contact with terminal 50 and an electrical circuit is completed, thereby causing current to flow through heating element 40. Element 40 is a relatively tightly wound spiral winding of Nichrome. Accordingly, it heats up quickly and soon attains a temperature sufficient to light a cigarette; it has a length of about four inches, and a diameter substantially equal to the diameter of a cigarette.

As shown in FIG. 3, heating element 40 is recessed with respect to front wall 12; note that the plane of the heating element is parallel to said front wall 12. The leading end of a cigarette must be inserted substantially squarely through opening 14 to light said cigarette. This is an important safety feature and prevents the heating element 40 from coming into contact with anything other than the leading end of a cigarette. Moreover, the bias on switch actuator 16 further ensures that the current flowing through said heating element will be shut off when said switch actuator 16 is released, i.e., the button acts as a dead man switch actuator. Note further that conductor 56 is inherently resilient so that switch actuator 16 is biased outwardly, i.e., away from contact 50, even in the absence of torsion spring 54.

It should also be noted that a plurality of pegs, collectively denoted 70, provide means for retaining the conductors 34, 36, 46, and 56 in place. Each peg 70 has the same structure as pivot peg 52, i.e., each peg extends between side walls 20 and 22, in interconnecting relation thereto. Pegs 70 are specifically positioned to form the respective paths of travel of conductors 36, 46, and 56, as shown.

It will thus be seen that the objects set forth above, and those made apparent from the foregoing description, are efficiently attained and since certain changes may be made in the above construction without departing from the scope of the invention, it is intended that all matters contained in the foregoing construction or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described, what is claimed is:

1. A cigarette lighter, comprising:

a hollow housing having a generally parallelepiped construction;

said hollow housing including a pair of mating housing halves;

a first and a second battery disposed within said hollow housing in side-by-side relation to one another;

a heating element positioned within said hollow housing;

a switch means for selectively electrically interconnecting said batteries and said heating element;

said switch means having a first and a second contact and said switch means being normally open;

a pivotally mounted switch actuator means for applying an external force to said switch means to drive said first and second contacts together;

said switch actuator means being pivotally mounted to said housing;

means for biasing said switch actuator means away from said switch means so that said switch means is open when said switch actuator means is in repose;

a first conductor disposed in electrically communicating relation between preselected opposite poles of said first and second batteries;

a second conductor disposed in electrically communicating relation between the other pole of said first battery and a first preselected end of said heating element;

a third conductor disposed in electrically communicating relation between the other pole of said second battery and a first contact of said switch means;

a fourth conductor disposed in electrically communicating relation between a second contact of said switch means and the second end of said heating element;

an opening formed in a preselected wall of said housing, said opening having a size sufficient to receive therethrough a leading end of a cigarette;

said opening and said heating element being disposed in spaced apart, axial alignment with one another so that said leading end of said cigarette, when inserted squarely through said opening, abuttingly engages said heating element;

a plurality of peg members disposed within said hollow housing, each of said peg members having a predetermined position and said peg members defining a path of travel for said second, third, and fourth conductors;

said switch actuator means being pivotally mounted on a preselected peg member;

said means for biasing said switch actuator means away from said switch means being a torsion spring that encircles said preselected peg member;

whereby pivotal activation of said switch actuator means to drive together said first and second contacts of said switch means results in flow of electrical current through said heating element and lighting of a cigarette leading end positioned against said heating element.

2. The lighter of claim 1, wherein said first and second contacts of said switch means are operatively associated with preselected parts of said third and fourth conductors, respectively.

3. The lighter of claim 2, wherein said preselected parts of said third and fourth conductors are disposed in closely spaced, parallel relation to one another.

4. The lighter of claim 3, wherein said heating element has a predetermined length and is spirally wound.

5. The lighter of claim 4, wherein said heating element is tightly wound so that the diameter of said heating element is substantially equal to the diameter of a cigarette.

6. The lighter of claim 5, wherein said heating element is disposed in parallel relation to the preselected wall of said housing having an opening formed therein.

7. The lighter of claim 6, wherein said housing is made of a thin, light-in-weight, durable plastic.

8. The lighter of claim 7, wherein said heating element is made of Nichrome.

* * * * *